US007056227B2

(12) United States Patent
Giraldi

(10) Patent No.: US 7,056,227 B2
(45) Date of Patent: Jun. 6, 2006

(54) GOLF PUTTER HAVING VARIED STRIKING SURFACE

(76) Inventor: Gerald G. Giraldi, 323 D'Arcy Ave., Trenton, NJ (US) 08629

( * ) Notice: Subject to any disclaimer, the term of this patent is extended or adjusted under 35 U.S.C. 154(b) by 683 days.

(21) Appl. No.: 09/844,989

(22) Filed: Apr. 30, 2001

(65) Prior Publication Data

US 2002/0160855 A1 Oct. 31, 2002

(51) Int. Cl.
*A63B 53/04* (2006.01)

(52) U.S. Cl. ..... 473/342; 473/329

(58) Field of Classification Search ..... 473/349, 473/329, 330, 324, 335, 342, 347
See application file for complete search history.

(56) References Cited

U.S. PATENT DOCUMENTS 4,795,158 A 1/1989 Kuykendall ..... 273/164
5,098,103 A 3/1992 MacKeil ..... 273/175
5,310,185 A * 5/1994 Viollaz et al. ..... 273/DIG. 23
5,322,285 A 6/1994 Turner ..... 273/164.1
5,398,935 A 3/1995 Katayama ..... 273/167 A
5,505,450 A 4/1996 Stuff ..... 273/167 J
6,319,150 B1 * 11/2001 Werner et al. ..... 473/324

* cited by examiner

*Primary Examiner*—Glenn Caldarola
*Assistant Examiner*—Tom P. Duong
(74) *Attorney, Agent, or Firm*—LaMorte & Associates

(57) ABSTRACT

A golf putter having a uniquely configured striking surface is claimed. The putter has a striking surface that is twisted between the toe of the putter and the heel of the putter. The loft angle associated with the striking surface of the putter varies from a positive loft angle near the heel to a negative loft angle near the toe. The striking surface of the putter has a midline. The striking surface is twisted about the mid-line. The plane of the twisted striking surface is also slightly curved to eliminate any concave curvatures created by the twist. A non-metallic insert is added to the striking surface. The non-metallic insert has thickness that varies as a function of its position along the mid-line.

12 Claims, 5 Drawing Sheets

GOLF PUTTER HAVING VARIED STRIKING SURFACE

BACKGROUND OF THE INVENTION

1. Field of the Invention

In general, the present invention relates to golf clubs. More particularly, the present invention relates to putters and the design of the head of the putter.

2. Prior Art Statement

Golf is a game that is played by millions of people worldwide. The rules that govern the game of golf are codified by the golf associations of the various sovereign countries in which it is played. Most all countries adapt rules that are consistent with those of the Royal And Ancient Golf Club of St. Andrews, Scotland.

In the United States, the rules of golf are written by the United States Golf Association (USGA). Among many other rules, the USGA has rules that limit the number of golf clubs a player can carry in their bag and the physical structure of the clubs that can be carried.

Since players can only carry a limited number of clubs, golf clubs have been designed that are highly versatile and can be adapted for different uses. For example, U.S. Pat. No. 5,322,285 to Turner, entitled Golf Putter, shows a golf putter having a face that is angled with different lofts in different areas. U.S. Pat. No. 5,505,450 to Stuff, entitled Golf Club Heads With Means For Imparting Corrective Action, shows a golf club with varied face grooves to provide a golf ball with different spins depending upon how the golf ball is struck.

A problem associated with making clubs multi-functional is that there exist many rules exist that prohibit different types of versatile club designs. For example, under the rules of the USGA, a golf club can only have a single striking surface on one side of a club. As such, a golf club with separate striking areas, such as those found in the above-referenced Stuff patent, would be illegal. The USGA rules also prohibit golf clubs that are mechanically adjustable, or have concave striking surfaces. As such, the ability for a golf club designer to produce a golf club that is both versatile and legal is limited.

In an attempt to create a golf club that has a striking face that is both versatile and legal, golf club designers have created golf clubs having a striking face that is twisted. A striking face that is twisted provides a striking surface that varies from point-to-point yet presents only a single striking surface. Such a prior art golf club design is exemplified by U.S. Pat. No. 5,098,103 to MacKeil, entitled Fixed Compensating Loft Golf Club Head. A problem associated with twisting the striking surface of a golf club is that the twisted shape produces a concave region on the striking surface. Concave surfaces are illegal. So in order to keep the golf club within the rules, the twisted striking face is also bowed. This produces a twisted and bowed surface, such as that shown in the above-cited MacKeil patent. If the striking surface of the MacKeil patent were applied to the face of a putter, the ability of a golfer to put a golf ball accurately would be limited. As such, although the golf club is versatile and legal, it is not of much practical use on a putter, because golfers cannot use the golf club accurately. The same problem occurs when golf putters are produced with striking surfaces that are curved spherically, cylindrically, torically or elliptically. Such striking surfaces are versatile, however, the ability for a golfer to accurately strike a golf ball with the exact desired point of a golf putter is highly limited. This makes the overall putter inaccurate and not useful to the player.

A need therefore exists in the art for a golf putter having a face that is versatile in use, is legal to use, yet can be accurately used by the average golfer. This need is met by the present invention as described and claimed below.

SUMMARY OF THE INVENTION

The present invention is a golf putter having a uniquely configured striking surface. The putter has a striking surface that is twisted between the toe of the putter and the heel of the putter. As a consequence, the loft angle associated with the striking surface of the putter varies from a positive loft angle near the heel to a negative loft angle near the toe. The striking surface of the putter has an imaginary mid-line. The striking surface is twisted about the mid-line. The plane of the twisted striking surface is also slightly curved to eliminate any concave curvatures created by the twist. To help compensate for accuracy errors created by the curved and twisted striking surface, a non-metallic insert is added to the striking surface. The non-metallic insert has a thickness that varies in a novel manner as a function of position. Accordingly, if a golf ball contacts the striking surface of the putter in an unintended position, the non-metallic insert at that location helps to provide the golf ball with an accurate trajectory and direction that is not adversely effected by the curvature and twist of the striking surface.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Although the present invention can be applied to most any golf club, such as an iron or wood-style club, the present invention is especially well suited for application on a putter. As such, by way of example, the technology of the present invention has been applied to a putter in the illustrated embodiments in order to set forth the best mode contemplated for the invention.

Figure 1:
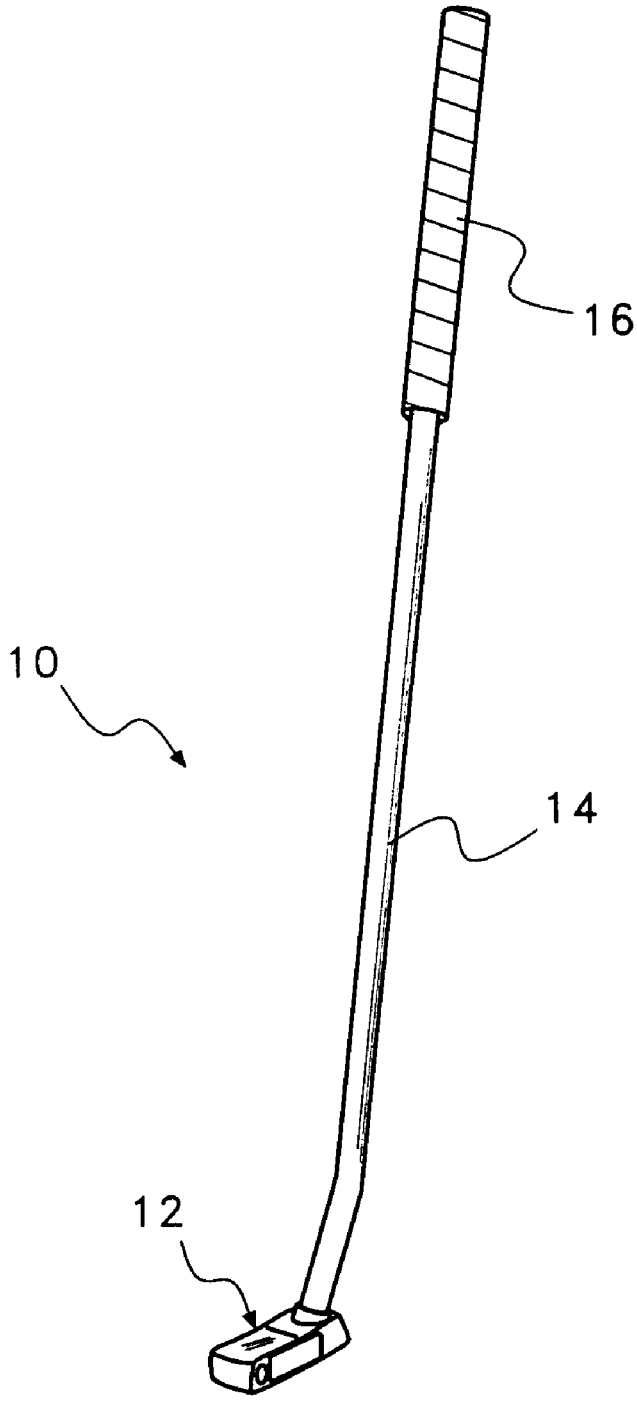
FIG. 1 is a perspective view of a golf putter in accordance with the present invention.

Referring to FIG. 1, an exemplary embodiment of a putter 10 is shown. Like most all traditional putters, the putter 10 consists of a putter head 12, a shaft 14 and a handle grip 16. The present invention addresses the physical structure of the putter head 12. In the prior art many different types of putter shafts and handle grips exist. Most any prior art shaft and/or handle grip can be adapted for use with the putter head 12 in accordance with the present invention.

Figure 2:
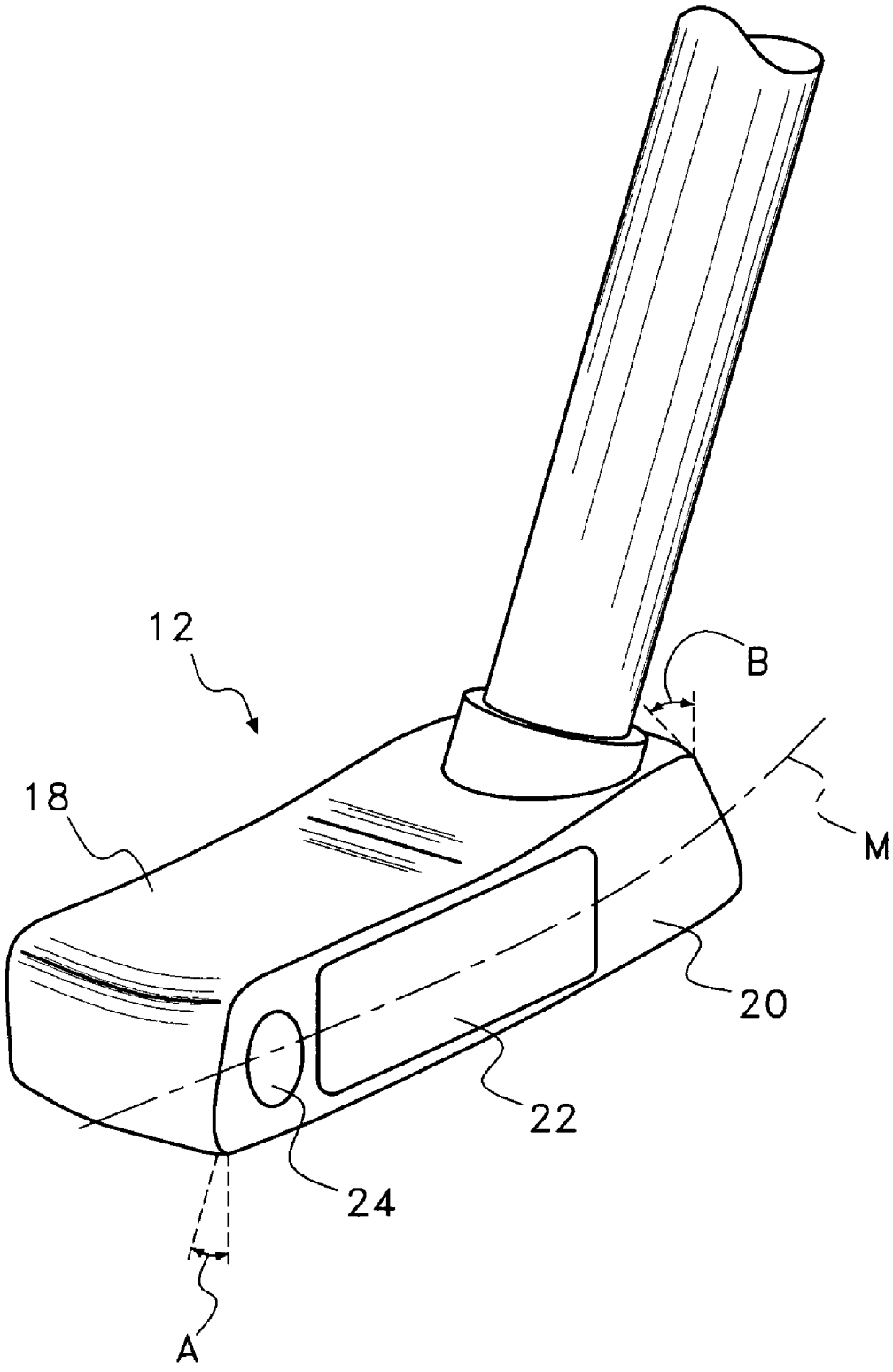
FIG. 2 is an enlarged perspective view of the putter head shown in FIG. 1.

Referring to FIG. 2, it can be seen that the putter head 12 has a main body 18. The face surface 20 of the main body 18 is the surface that actually contacts a golf ball when the putter is used to play golf. The main body 18 of the putter head 12 can be made from any traditional putter material, such as wood, brass, aluminum, stainless steel or the like. In the preferred embodiment, the body of the putter is a cast metal. The face surface 20 of the putter head 12, however, is not totally fabricated from the same material as is the main body 18. Rather, on the face surface 20 of the putter head 12, there are two separate inserts. The first insert is a striking surface insert 22. The striking surface insert 22 is made from a non-metallic material and serves a purpose that will later be explained. The second insert is a weight insert 24. The weight insert 24 is made from a high density metal, such as tungsten or lead, and provides balance to the putter's face surface, as will also be later explained.

In many prior art putters, the face surface of the putter head is angled. The angle of the face surface of a golf club is referred to as the loft of the club, wherein the loft is the angle of the plane of the striking surface relative a vertical plane. Under the USGA rules, a putter cannot have a loft angle greater than ten degrees. Nor can a putter have a face surface with more than one distinct striking surface.

As is shown by FIG. 2, the face surface 20 of the putter head 12 has a loft that changes along the length of the face surface 20. The change in the loft is consistent across the face surface 20 of the putter head 12. Consequently, the face surface 20 of the putter head 12 only provides one distinct striking surface in compliance with USGA rules. At the front, or toe, of the putter head 12, the face surface 20 has a first loft angle. The first loft angle is created because the face surface 20 of the putter head 12 is twisted in a clockwise direction to a predetermined loft angle A. The negative loft angle A is between two degrees and seven degrees, with a five degree loft angle being preferred. At the rear, or heel, of the putter head 12, the face surface 20 is twisted in a counter-clockwise direction to a predetermined second loft angle B. The positive loft angle B is preferably ten degrees, which is the maximum loft allowed under USGA rules.

The twist of the face surface 20 of the putter head 12 is symmetrically created about the imaginary mid-line M on the face surface 20. However, although the imaginary mid-line M does pass across the center of the face surface 20, the imaginary mid-line M is not a straight line. Rather, the imaginary mid-line M is slightly curved in relation to the vertical plane. The vertical position of the imaginary mid-line M on the face surface 20 of the putter head 12 corresponds to half the height of a standard tournament golf ball. Accordingly, when the face surface 20 is used to contact the golf ball, it is the area of the face surface 20 at the imaginary mid-line that first contacts the equator of the golf ball.

Figure 3:
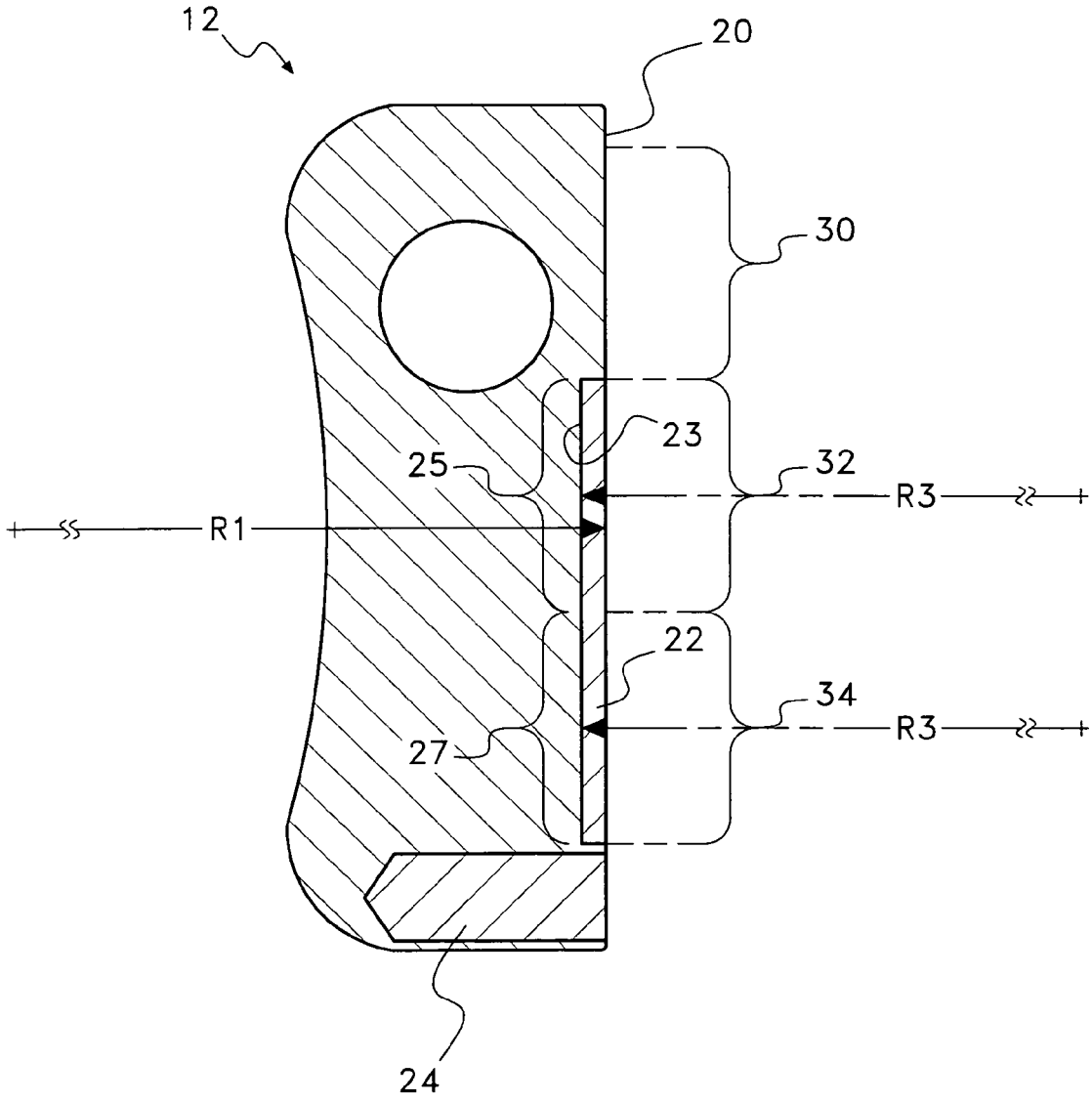
FIG. 3 is a cross-sectional view of the putter head sectioned at the mid-line shown in FIG. 2.
Figure 4B:
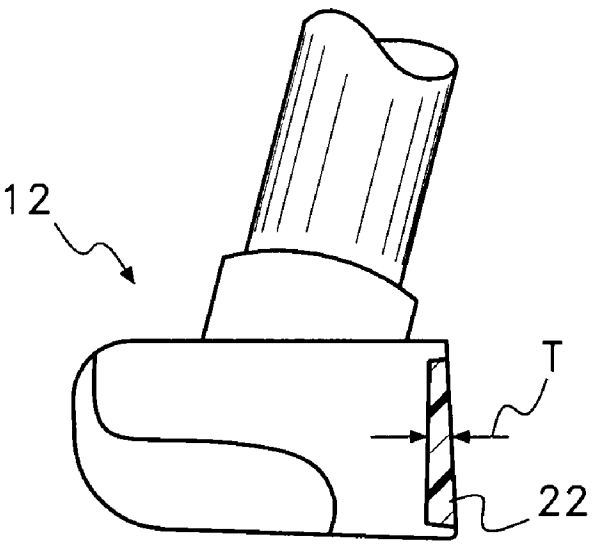
FIG. 4 is a cross-sectional view of the putter head contacting a golf ball and containing an enlarged region.
Figure 4A:
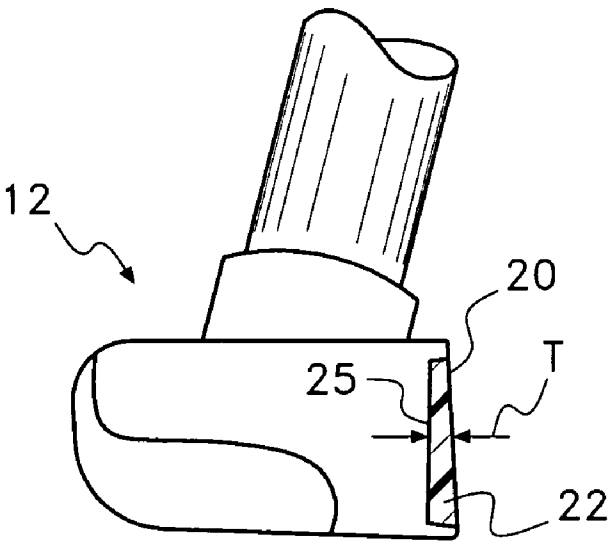

Referring to FIG. 3, a cross-section of the putter head 12 is shown sectioned along the plane of the imaginary mid-line M (FIG. 2). From FIG. 3, it can be seen that the face surface 20 of the putter head 12 at the point of the imaginary mid-line M is curved to create a convex surface. The radius of curvature R1 is preferably between 54 inches and 90 inches. Such a radius of curvature R1 eliminates concave sections in the face surface 20 of the putter head 12 that are created by the twisting structure. By adding the radius of curvature R1, just enough convex curvature is added to the face surface to cancel out the naturally occurring concave sections. As a result, the face surface 20 of the putter head 12 does not have any concave sections and the face surface 20 complies with the USGA rules.

The putter head 12 is designed to have three contact sections on the face surface 20. The three contact sections include the heel section 30, which is proximate the heel of the putter head 12. The toe section 34, which is proximate the toe of the putter head 12. And the central section 32, which is between the heel section 30 and the toe section 34. The heel section 30 of the putter head 12 is positioned in front of the point where the shaft engages the putter head 12. The central section 32 of the putter head 12 is positioned in front of the geometrical center of the putter head 12. Lastly, the toe section 34 of the putter head 12 is positioned in front of the area that lies between the geometrical center of the putter head 12 and the toe end of the putter head 12.

If a golfer were to strike a golf ball with the heel section 30 of the putter head 12, the positive loft of the face surface 20 would act as a golfing iron and would propel the golf ball both upward and forward. This is beneficial for making shots from the fringe at the edge of a putting green. If a golfer were to strike a golf ball in the central section 32 of the putter head 12, then the golf ball would contact a surface that has traditional putter's loft. The golf ball would then roll forward as if it were hit with a traditional putter. Lastly, if a golfer were to strike a golf ball in the toe section 34 of the putter head 12, the golf ball would be driven both forward and downward into the green, thereby imparting early overspin to a golf ball and enhancing directional stability on short putts.

The center of the heel section 30 corresponds to the point where the shaft of the putter engages the putter head 12. Since the heel section 30 is in line with the center of the putter's shaft, no twisting forces are experienced in the shaft when a golf ball is struck with the heel section 30 of the face surface 20. Similarly, the mass of the putter head 12 is relatively evenly distributed around the central section 32. Accordingly, when a golf ball is struck with the central section 32 of the putter head 12, no significant twisting forces are experienced in the shaft. However, when a golf ball is struck with the toe section 34 of the putter head, a twisting force may be experienced in the shaft. The twisting force can cause the shaft to rotate slightly in the hands of the golfer and create an inaccurate shot. To help correct this situation, a balancing weight insert 24 is placed in the putter head 12 in the toe section 34. The balancing weight insert 24 adds mass to the toe section 34 of the putter head 12 and helps to reduce twisting forces when a golf ball is struck with the toe section 34.

The striking surface insert 22 is provided on the face surface 20 to minimize errors caused by the curvature and twist of the face surface 20. The striking surface insert 22 extends across both the central section 32 and the toe section 34 of the face surface 20. The striking surface insert 22 is a non-metallic insert having a hardness of no less than 90 Shore "A". A minimum hardness rating of 90 Shore "A" is required in order to comply with USGA rules. The striking surface insert 22 is preferably a synthetic hard rubber or similar elastomeric material having a Shore "A" rating of between 90 Shore and 95 Shore "A".

The striking surface insert 22, however, does not have a uniform thickness along its length. The front edge of the striking surface insert 22 is part of the face surface 20 of the putter head 12 and conforms to the curvature and twist of that surface. The rear edge 23 of the striking surface insert 22 has a twist that is opposite in contour to that of the of the face surface 20. Furthermore, the rear edge 23 of the striking surface insert 22 does not follow the same curvature as does the face surface 20. Rather, the rear edge 23 of the striking surface insert 22 follows a compound curve. The rear edge 23 of the striking surface insert 22 follows the path of two intersecting curves that create a compound curve. In a first area 25, behind the central section 32 of the face surface 20, the rear edge 23 has a radius of curvature R2. The radius of curvature R2 is preferably between six inches and one hundred inches. The curvature of the first section 25 of the rear edge 23 of the striking surface insert 22 is concave, as compared to the convex curvature of the face surface 20 of the putter head 12. As such, the striking surface insert 22 is thicker behind the center of the central section 32 than it is behind either end of the center section 32.

In a second area 27, behind the toe section 34 of the face surface 20, the rear edge 23 has a radius of curvature R3. The radius of curvature R3 is also preferably between six inches and one hundred inches and is concave. However, the radius of curvature R2 for the first area 25 and the radius of curvature R3 of the second area 27 have different points of origin. As such, the striking surface insert 22 is also thicker behind the center of the toe section 34 than it is behind either end of the toe section 34.

Because the face surface 20 of the putter head 12 is both twisted and curved, if a golfer were to strike a golf ball at an unintended point on the putter head 12, it may be expected that the golf ball would be propelled at a perpendicular to the point of contact, thereby resulting in a trajectory slightly off line from the desired direction. However, the presence of the striking surface insert 22 compensates for this tendency to produce more accuracy.

Figure 4:
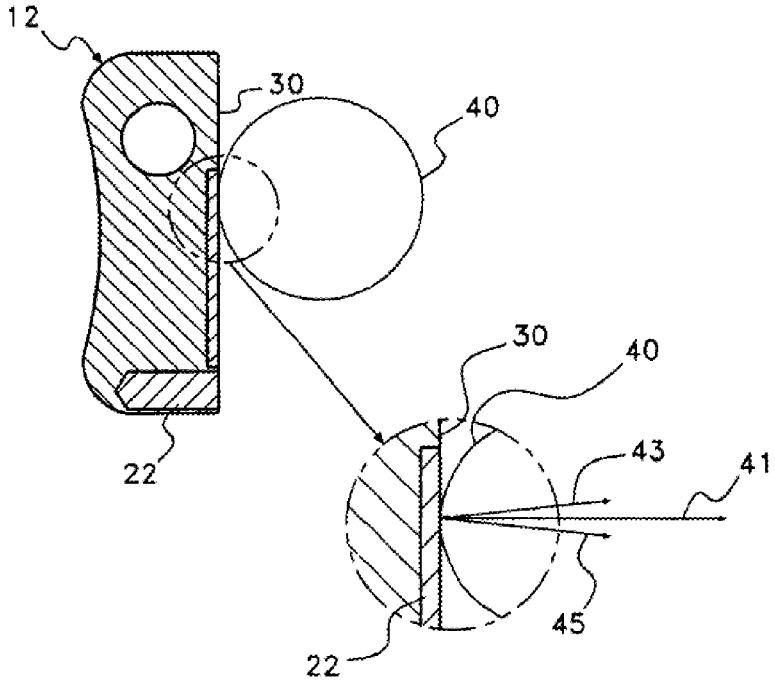

Referring to FIG. 4, the putter head 12 is shown striking a golf ball 39. The golf ball 39 is being struck with the central section 32 (FIG. 2) of the face surface 30 of the putter head 12. However, the golfer has mistakenly contacted the golf ball 39 at a point that does not correspond to the center of the center section. In FIG. 4, arrow 41 shows the path on which the golfer desired the golf ball to roll. The higher arrow 43 shows the direction of force that would be applied to golf ball 39 by the curved and twisted face surface 30 of the putter head 12, if the striking surface insert 22 were not present. As would be expected, the direction of the higher arrow 43 is different from direction of the arrow 41 of the desired path. However, the striking surface insert 22 is present. The curvature and twist of the insert 22 applies a force to the golf ball 39 that acts along lower arrow 45. The resultant force of the force shown as upper arrow 43 and lower arrow 45 corresponds to the arrow 41 of the desired path. As such, the curvature and twist of the striking surface insert 22 acts like a corrective lens and compensates for the curvature of the face surface 20. The result is a golf ball 39 that travels in the direction desired even when miss-struck with the putter head 12.

Figure 5B:
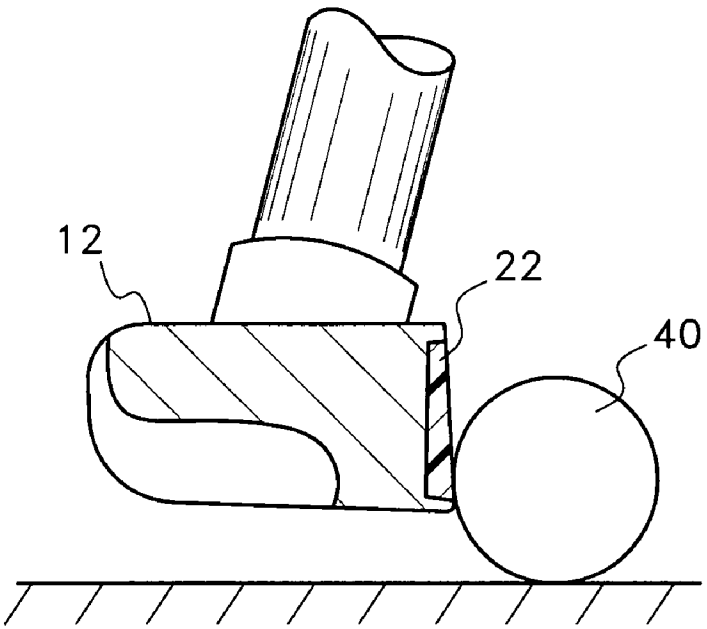
FIG. 5B is a cross-sectional view of the putter head shown while improperly striking a golf ball.
Figure 5A:
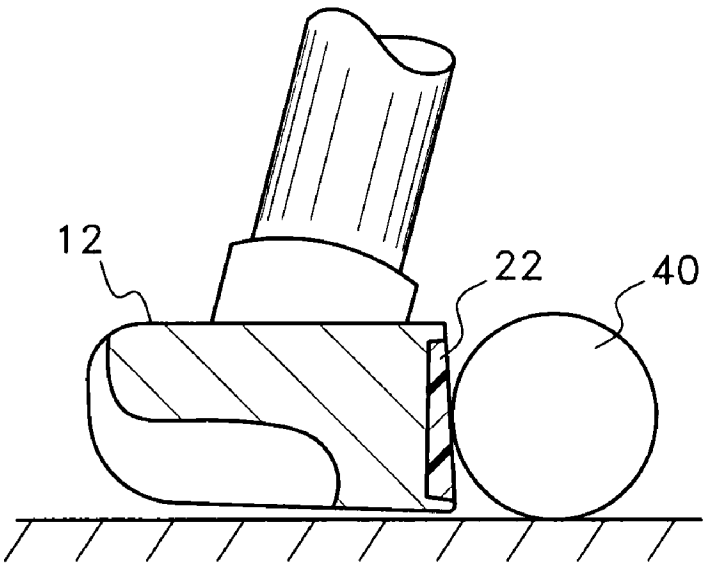
FIG. 5A is a cross-sectional view of the putter head shown while properly striking a golf ball.

Referring to FIG. 5A, it can be seen that if the putter head 12 properly strikes a golf ball 40, the striking surface insert 22 first contacts the golf ball 40 at the point of the imaginary mid-line M (FIG. 2). As has been explained, the striking surface insert 22 has a twist and compound rear curvature that compensates for the twist and the curvature of the face surface 20 of the putter head. If the golf ball strikes the face surface directly in the center of the center section 32 (FIG. 2) than the presence of the striking surface insert 22 has little effect on the golf ball. However, referring to FIG. 5B, it can be seen that if the putter head 12 strikes the golf ball 40 at a point higher than is optimal, the golf ball 40 contacts the striking surface insert 22 at a point below the imaginary mid-line M (FIG. 2). The thickness of the striking surface insert 22 below the imaginary mid-line varies as a function of the loft angle of the face surface. Accordingly, if a golf ball is struck high near the toe end of the putter head 12, the golf ball 40 would contact a thinner section of the striking surface insert 22 than would a golf ball struck near the heel end. Due to the twisted and curved shaped of the striking surface insert 22, the rebound force supplied by the striking surface insert helps correct the normal tendency of the golf ball to rebound in a direction perpendicular to the face surface 20 at the unintended contact point. The result is a trajectory for the golf ball that is closer to what was desired than otherwise would be possible with a solid metal or wooden putter face. Since the material of the striking surface insert 22 is more forgiving that the metal of the putter head 12, rebound energy can be focused through the shape of the striking surface insert 22 to minimizes the degree of inaccuracy caused by the golfer's miss-strike.

It will be understood that the embodiments of the present invention described and illustrated herein are merely exemplary and a person skilled in the art can make many variations to the embodiment shown without departing from the scope of the present invention. For example, many different types of putter body shapes can be used. Additionally, the length of the putter head can be altered to the likings of a particular player. The angles of the changing loft can also be adjusted provided the selected lofts are within the USGA guidelines. All such variations, modifications and alternate embodiments are intended to be included within the scope of the present invention as defined by the appended claims.

What is claimed is:

1. A putter head assembly, comprising:

a putter body having a toe end, a heel end and a face surface that extends from said heel end toward said toe end, wherein said face surface has a loft angle configuration that continuously varies from a positive loft angle to a negative loft angle as said face surface extends from said heel end toward said toe end;

a non-metallic insert disposed in at least a portion of said face surface, wherein said non-metallic insert conforms to the loft angle configuration of said face surface.

2. The assembly according to claim 1, wherein said face surface has a mid-line that extends along the center of said face surface between said heel end and said toe end.

3. The assembly according to claim 2, wherein said mid-line of said face surface follows a curve having a radius of curvature between 54 inches and 90 inches.

4. The assembly according to claim 2, wherein said non-metallic insert has a varying thickness along said mid-line and varies as a function of position along said mid-line.

5. The assembly according to claim 1, wherein said positive loft angle is ten degrees.

6. The assembly according to claim 1, wherein said non-metallic insert has a front surface and an opposite rear surface wherein said front surface conforms to said loft angle configuration.

7. The assembly according to claim 6, wherein said rear surface has a plurality of sections and each of said sections has its own radius of curvature.

8. A putter, comprising:

a shaft having a first end and a second end;

a handle grip coupled to said first end of said shaft;

a putter head coupled to said second end of said shaft, said putter head including a face surface having a toe end and a heel end, said face surface being symmetrically disposed around an imaginary mid-line that extends from said toe end to said heel end, wherein said face has a loft angle configuration that continuously varies between said toe end and said heel end;

a non-metallic insert disposed in at least a portion of said face surface, wherein said non-metallic insert conforms to the loft angle configuration of said face surface.

9. The putter according to claim 8, wherein said mid-line follows a curve having a radius of curvature between 54 inches and 90 inches.

10. The putter according to claim 8, wherein said non-metallic insert has a front surface and an opposite rear surface, wherein said front surface conforms to said loft angle configuration.

11. The putter according to claim 10, wherein said rear surface has a plurality of sections and each of said sections has its own radius of curvature.

12. The putter according to claim 8, wherein said non-metallic insert has a thickness that varies along said mid-line as a function of position on said mid-line.

* * * * *

UNITED STATES PATENT AND TRADEMARK OFFICE

CERTIFICATE OF CORRECTION

PATENT NO. : 7,056,227 B2
APPLICATION NO. : 09/844989
DATED : June 6, 2006
INVENTOR(S) : Giraldi It is certified that error appears in the above-identified patent and that said Letters Patent is hereby corrected as shown below:

In the Old drawings please delete Fig. 4 that was printed in the patent.
The new formal drawing of fig. 4 that is illustrated is attached to be inserted in the patent.

Signed and Sealed this

Tenth Day of March, 2009

John Doll

JOHN DOLL
*Acting Director of the United States Patent and Trademark Office*